US006902633B2

(12) United States Patent
King et al.

(10) Patent No.: US 6,902,633 B2
(45) Date of Patent: Jun. 7, 2005

(54) NICKEL-BASE-ALLOY

(75) Inventors: Warren Tan King, St. Johnsville, NY (US); John Herbert Wood, St. Johnsville, NY (US); Gangjigang Feng, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,824

(22) Filed: May 9, 2003

(65) Prior Publication Data

US 2004/0223868 A1 Nov. 11, 2004

(51) Int. Cl.[7] ..... C22C 19/05

(52) U.S. Cl. ..... 148/428; 420/448; 420/449; 420/450; 420/451; 420/460

(58) Field of Search ..... 148/428; 420/448, 420/449, 450, 451, 460

(56) References Cited

U.S. PATENT DOCUMENTS

| | | | | |
|---|---|---|---|---|
| 3,850,624 A | * | 11/1974 | Hulit et al. | 420/448 |
| 3,902,862 A | * | 9/1975 | Moll et al. | 75/246 |
| RE28,681 E | * | 1/1976 | Baldwin | |
| 3,976,480 A | * | 8/1976 | Watanabe | 420/449 |
| 4,078,951 A | | 3/1978 | Denzine et al. | 148/428 |
| 4,608,094 A | * | 8/1986 | Miller et al. | 148/677 |
| 5,938,863 A | * | 8/1999 | Malley | 148/428 |

FOREIGN PATENT DOCUMENTS

| | | |
|---|---|---|
| EP | 0669403 | 8/1995 |
| GB | 2 148 323 A * | 5/1985 |

OTHER PUBLICATIONS

Patent Abstracts of Japan, Jul. 22, 1986, vol. 0102, No. 08 (C–361) and JP 61 048562 A, Hitachi Ltd, Mar. 10, 1986.

J.R. Davis; "Heat–Resistant Materials"; 1997, ASM International, Ohio, USA, XP002291906; ISBN: 0–871780–5596–6; pp. 221–227; table 2.

* cited by examiner

*Primary Examiner*—John P Sheehan
(74) *Attorney, Agent, or Firm*—Ernest Cusick; Gary M. Hartman; Domenica N. S. Hartman

(57) ABSTRACT

A nickel-base alloy consists of, by weight, about 15.0 to about 17.0% chromium, about 7.0 to about 10.0% cobalt, about 1.0 to about 2.5% molybdenum, about 2.0 to about 3.2% tungsten, about 0.6 to about 2.5% columbium, less than 1.5% tantalum, about 3.0 to about 3.9% aluminum, about 3.0 to about 3.9% titanium, about 0.005 to about 0.060% zirconium, about 0.005 to about 0.030% boron, about 0.07 to about 0.15% carbon, the balance nickel and impurities. Preferably, columbium is present in an amount greater than tantalum. Tantalum can be essentially absent from the alloy, i.e., only at impurity levels.

11 Claims, 4 Drawing Sheets

NICKEL-BASE-ALLOY

BACKGROUND OF INVENTION

1. Field of the Invention

The present invention generally relates to nickel-base alloys. More particularly, this invention relates to a castable and weldable nickel-base superalloy that exhibits desirable properties suitable for gas turbine engine applications.

2. Description of the Related Art

The superalloy IN-738 and its low-carbon version (IN-738LC) have a number of desirable properties for gas turbine engine applications, such as inner shrouds, latter-stage buckets (blades), and nozzles (vanes) in the turbine section of an industrial gas turbine. The composition of IN-738 can vary slightly among producers, with one publication listing the IN-738 composition, by weight, as 15.7–16.3% chromium, 8.0–9.0% cobalt, 1.5–2.0% molybdenum, 2.4–2.8% tungsten, 1.5–2.0% tantalum, 0.6–1.1% columbium (niobium), 3.2–3.7% aluminum, 3.2–3.7% titanium (Al+Ti=6.5–7.2%), 0.05–0.15% zirconium, 0.005–0.015% boron, 0.15–0.20% carbon, the balance nickel and impurities (e.g., iron, manganese, silicon and sulfur). IN-738LC differs in its boron, zirconium and carbon contents, with suitable ranges for these constituents being, by weight, 0.007–0.012% boron, 0.03–0.08% zirconium, and 0.09–0.13% carbon.

As with the formulation of other superalloys, the composition of IN-738 is characterized by controlled concentrations of certain critical alloying elements to achieve a desired mix of properties. For use in gas turbine applications, such properties include high temperature creep strength, oxidation and corrosion resistance, resistance to low cycle fatigue, castability and weldability. If attempting to optimize any one of the desired properties of a superalloy, other properties are often adversely affected. A particular example is weldability and creep resistance, both of which are of great importance for gas turbine engine buckets. However, greater creep resistance results in an alloy that is more difficult to weld, which is necessary to allow for repairs by welding.

While IN-738 has performed well in certain applications within gas turbine engines, alternatives would be desirable. Of current interest is the reduction in tantalum used in view of its high cost. Though tantalum nominally constitutes only about 1.8 weight percent of IN-738, its reduction or elimination would have a substantial impact on product cost in view of the tonnage of alloy used.

SUMMARY OF INVENTION

The present invention provides a nickel-base alloy that exhibits a desirable balance of high-temperature strength (including creep resistance), oxidation and corrosion resistance, resistance to low cycle fatigue, castability and weldability, so as to be suitable for certain components of a gas turbine engine, particularly inner shrouds and selected latter-stage bucket applications of industrial turbine engines. These properties are achieved with an alloy in which tantalum is eliminated or at a relatively low level, and in which a relatively high level of columbium is present as compared to IN-738.

According to the invention, the nickel-base alloy consists of, by weight, about 15.0 to about 17.0% chromium, about 7.0 to about 10.0% cobalt, about 1.0 to about 2.5% molybdenum, about 2.0 to about 3.2% tungsten, about 0.6 to about 2.5% columbium, less than 1.5% tantalum, about 3.0 to about 3.9% aluminum, about 3.0 to about 3.9% titanium, about 0.005 to about 0.060% zirconium, about 0.005 to about 0.030% boron, about 0.07 to about 0.15% carbon, the balance nickel and impurities. Preferably, columbium is present in an amount greater than tantalum, such as at least 1.4 weight percent, while the tantalum content of the alloy is more preferably less than 1.0%, and can be essentially absent from the alloy, i.e., only impurity levels are present (e.g., about 0.05% or less). The alloy of this invention has properties comparable to, and in some instances better than, those of the IN-738 alloy. Consequently, the alloy of this invention provides an excellent and potentially lower-cost alternative to IN-738 as a result of reducing or eliminating the requirement for tantalum.

Other objects and advantages of this invention will be better appreciated from the following detailed description.

DETAILED DESCRIPTION

Figure 1:
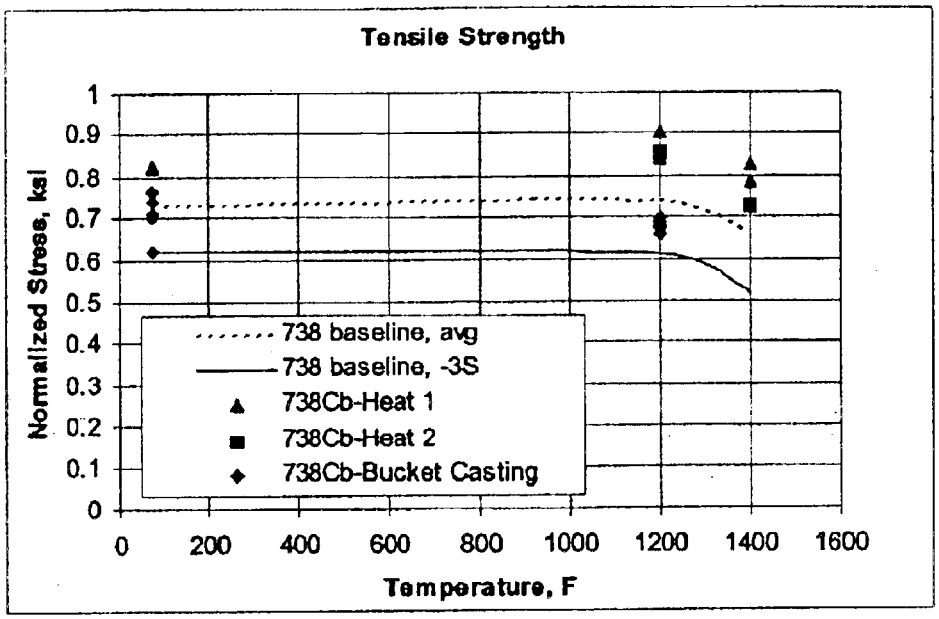
FIGS. 1 through 3 are graphs plotting tensile strength, yield strength, and percent elongation versus temperature for nickel-base alloys within the scope of the present invention.

The present invention was the result of an effort to develop a nickel-base alloy having properties comparable to the nickel-base alloy commercially known as IN-738, but with a chemistry that allows for the reduction or complete elimination of tantalum. The investigation resulted in the development of a nickel-base alloy whose properties are particularly desirable for inner shrouds and selected latter-stage bucket applications of industrial turbine engines, though other high-temperature applications are foreseeable. For the applications of particular interest, necessary properties include high-temperature strength (including creep resistance), oxidation and corrosion resistance, resistance to low cycle fatigue, castability and weldability. The approach of the investigation resulted in the increase in columbium to substitute for the absence of tantalum, and as a result radically altered two of the minor alloying elements of IN-738 that are known to affect the gamma-prime precipitation hardening phase.

The high-temperature strength of a nickel-base superalloy is directly related to the volume fraction of the gamma-prime phase, which in turn is directly related to the total amount of the gamma prime-forming elements (aluminum, titanium, tantalum and columbium) present. Based on these relationships, the amounts of these elements required to achieve a given strength level can be estimated. The compositions of the gamma-prime phase and other secondary phases such as carbides and borides, as well as the volume fraction of the gamma-prime phase, can also be estimated based on the starting chemistry of the alloy and some basic assumptions about the phases which form. However, other properties important to turbine engine shrouds and buckets, such as weldability, fatigue life, castability, metallurgical stability and oxidation resistance, cannot be predicted from the amounts of these and other elements present in the alloy.

Two alloys having the approximate chemistries set forth in Table I below Were formulated during the investigation. Test slabs with dimensions of about ⅞×5×9 inches (about 2×13×23 cm) were produced by investment casting and then solution heat treated at about 2050 Â° F. (about 1120 Â° C.) for about two hours, followed by aging at about 1550 Â° F. (about 845 Â° C.) for about four hours. The specimens were then sectioned by wire EDM and machined from the castings in a conventional manner. To assess castability, several full-sized gas turbine buckets were also cast from the Heat 1 alloy and sectioned for mechanical testing.

TABLE I

| Alloy | Heat 1 | Heat 2 |
|---|---|---|
| Cr | 16.0 | 16.3 |
| Co | 8.3 | 8.6 |
| Mo | 1.6 | 1.7 |
| W | 2.6 | 2.5 |
| Ta | <0.01 | 0.05 |
| Cb | 1.75 | 1.85 |
| Al | 3.32 | 3.49 |
| Ti | 3.34 | 3.43 |
| Zr | 0.040 | 0.021 |
| B | 0.008 | 0.016 |
| C | 0.11 | 0.10 |
| Ni | balance | balance |

The above alloying levels were selected to evaluate the potential for replacing tantalum with columbium, but otherwise were intended to retain the IN-738 composition with the exception of carbon (at the IN-738LC level) and zirconium (at the IN-738LC level (Heat 1) and between IN-738 and IN-738LC levels (Heat 2)).

Figure 2:
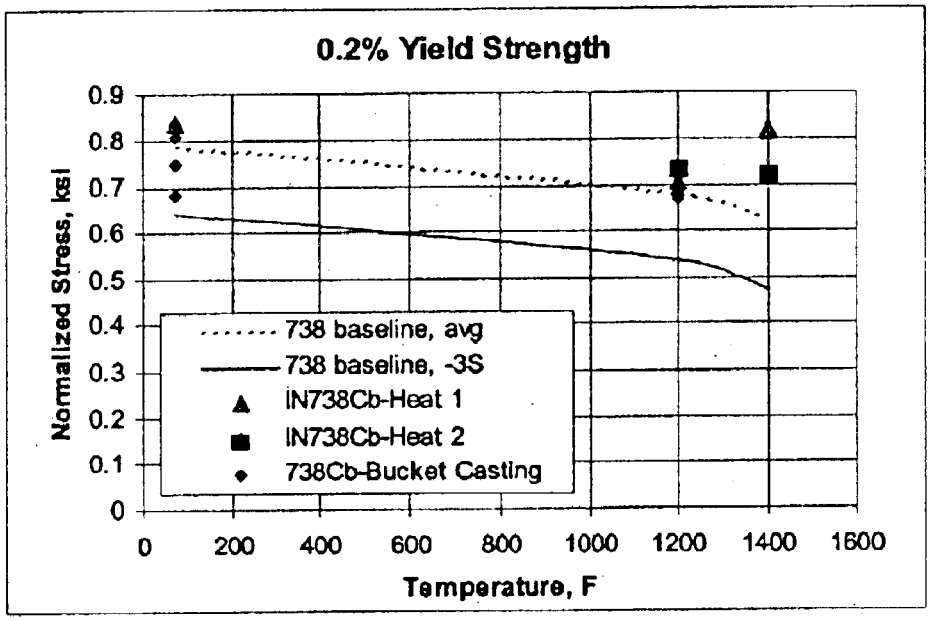
Figure 3:
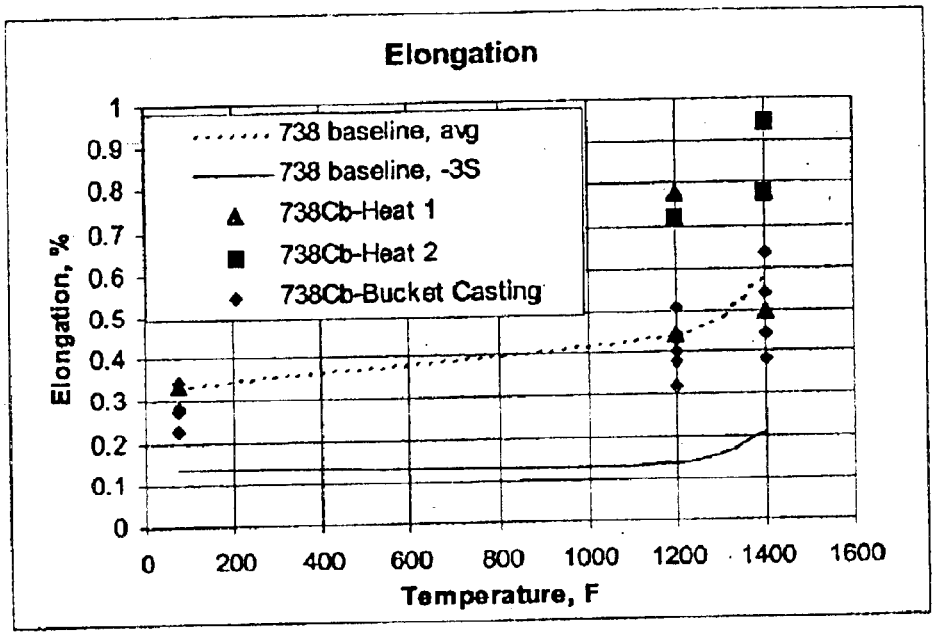

Tensile properties of the alloys were determined with standard smooth bar specimens. The normalized data are summarized in FIGS. 1, 2 and 3, in which 738 baseline, avg and 738 baseline, −3S plot historical averages, of IN-738 for the particular property. Also evaluated were specimens machined from buckets cast from the Heat 1 alloy. The data indicate that tensile and yield strengths of the Heat 1 and Heat 2 specimens were similar to or higher than the IN-738 baseline and ductility was slightly improved, indicating that the experimental alloys might be suitable alternatives to IN-738.

Figure 4:
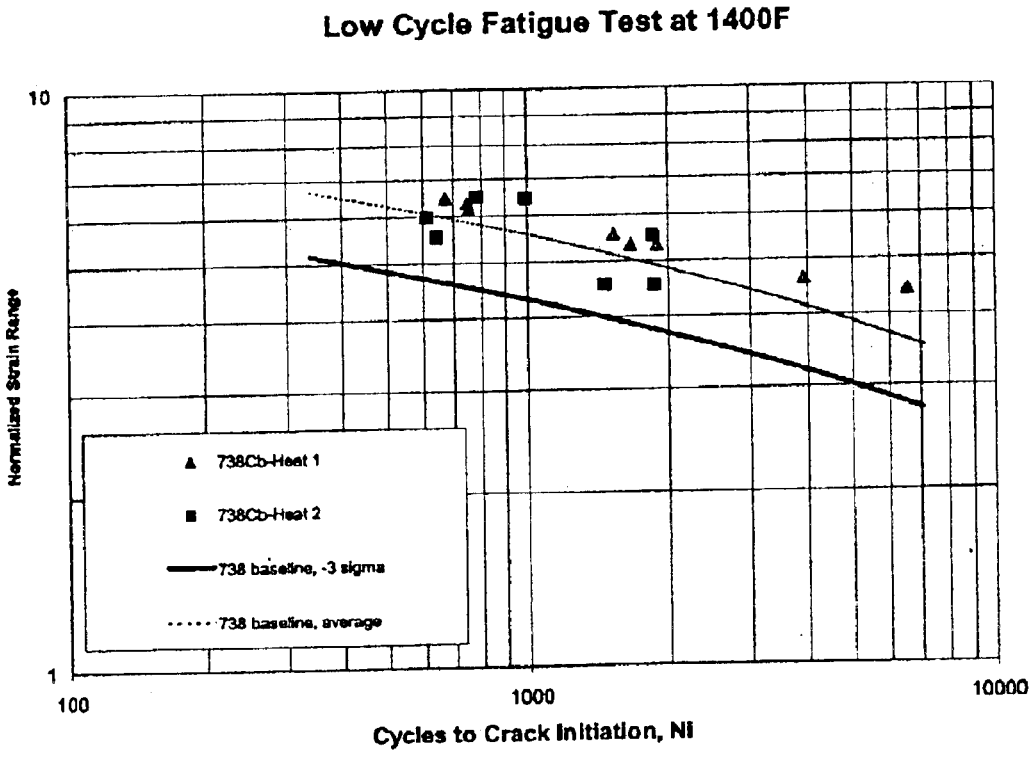
FIGS. 4 and 5 are graphs plotting low cycle fatigue life at 1400 Â° F. and 1600 Â° F., respectively, for the same alloys represented in FIGS. 1 through 3.
Figure 5:
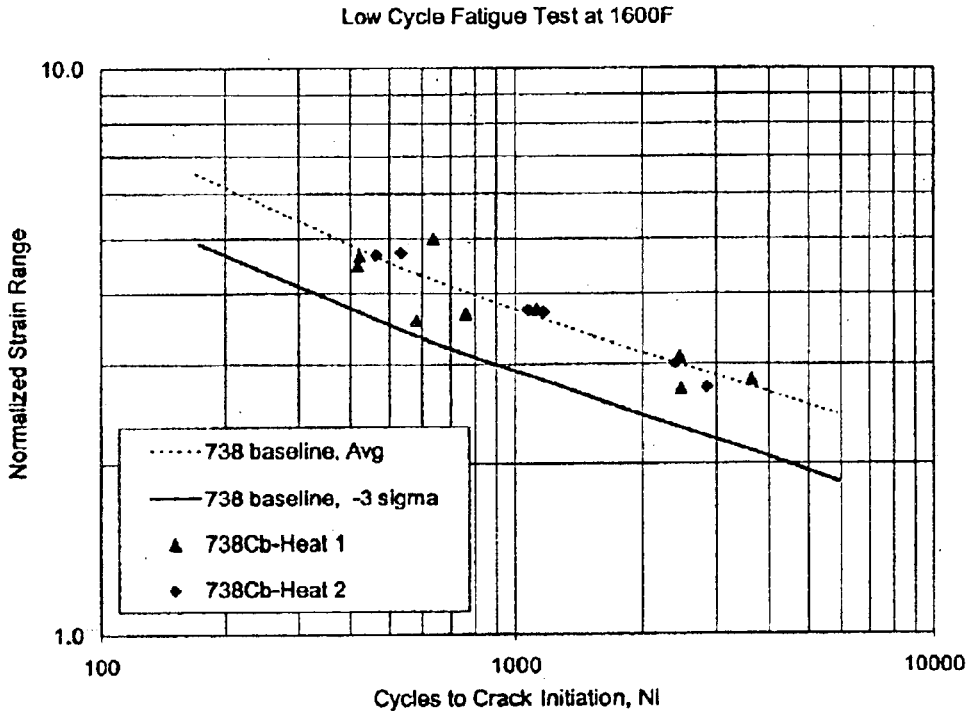

FIGS. 4 and 5 are graphs plotting low cycle fatigue (LCF) life at about 1400 Â° F. (about 760 Â° C.) and about 1600 Â° F. (about 870 Â° C.), respectively, for the Heat 1 and Heat 2 alloys in comparison to IN-738 baseline data. The tests were conducted under the strain-controlled condition and about 0.333 Hz cyclic loading, with an approximate two-minute hold time at the peak of the compression strain. In both tests, 0.25 inch (about 8.2 mm) bars were cycled to crack initiation per ASTM specification E606. The plots indicate that the LCF lives of the Heat 1 and Heat 2 alloys were essentially the same as the IN-738 baseline at both temperatures tested.

Figure 6:
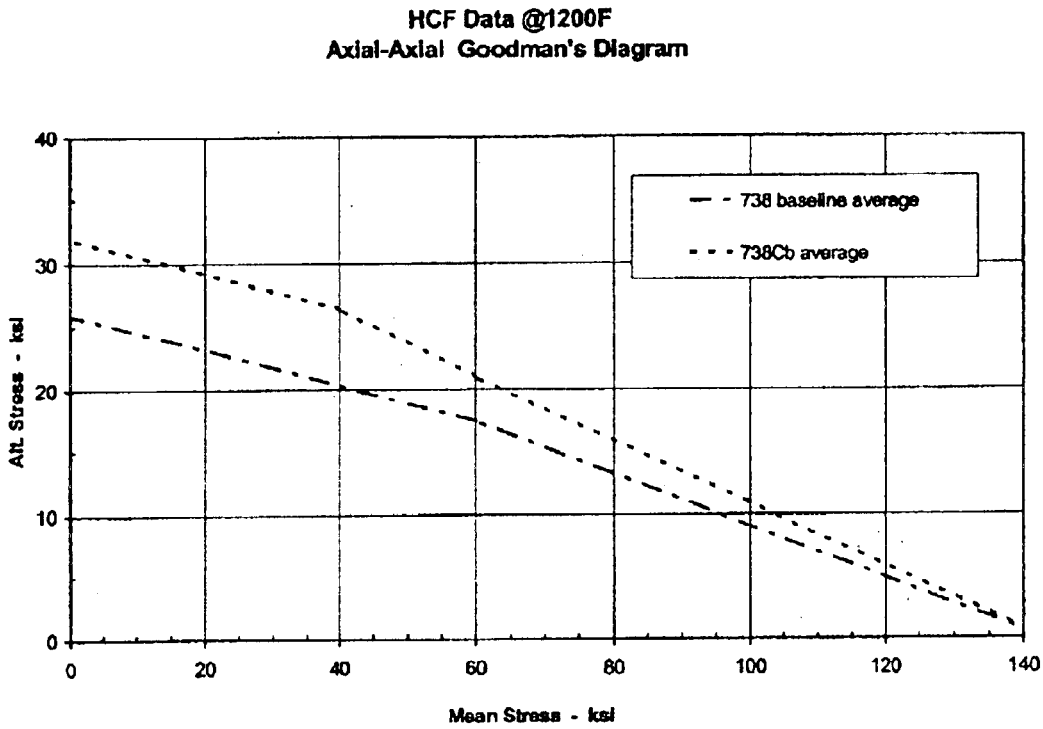
FIG. 6 is a graph plotting high cycle fatigue life at 1200 Â° F. for the same alloys represented in FIGS. 1 through 3.

FIG. 6 is a Goodman's diagram comparing average high cycle fatigue (HCF) life of the Heat 1 and Heat 2 alloys with IN-738 baseline data at about 1200 Â° F. (about 650 Â° C.). Unlike the LCF tests, the HCF test was conducted under the stress-controlled condition and about 30 to 60 Hz cyclic loading. The curves in the Goodman's diagram represent the fatigue endurance limit at ten million cycles. From FIG. 6, it can be seen that the average HCF life of the Heat 1 and Heat 2 alloys was significantly better than the IN-738 baseline.

Figure 7:
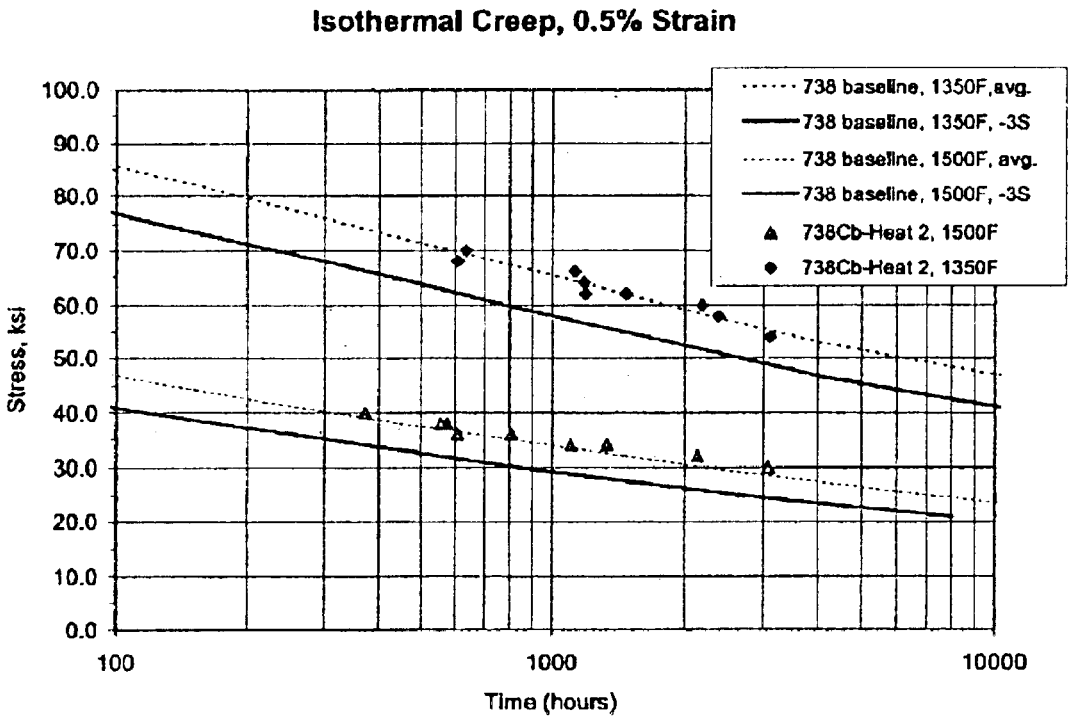
FIG. 7 is a graph plotting creep life at 1350 Â° F. and 1500 Â° F. for the same alloys represented in FIGS. 1 through 3.

FIG. 7 is a graph plotting creep life for the Heat 1 and Heat 2 alloys and IN-738 at a strain level of about 0.5% and temperatures of about 1350 Â° F. (about 730 Â° C.) and about 1500 Â° F. (about 815 Â° C.). At both test temperatures, the Heat 1 and Heat 2 alloys exhibited creep lives that were essentially the same as IN-738.

Additional tests were performed on the Heat 1 and Heat 2 alloys to compare various other properties to IN-738. Such tests included oxidation resistance, weldability, castability, fatigue crack growth, and physical properties. In all of these investigations, the properties of the Heat 1 and Heat 2 alloys were essentially identical to that of the IN-738 baseline.

On the basis of the above, an alloy having the broad, preferred and nominal compositions (by weight) summarized in Table II is believed to have properties comparable to IN-738 and therefore suitable for use as the alloy for inner shrouds and buckets of an industrial gas turbine engine, as well as other applications in which similar properties are required.

TABLE II

| | Broad | Preferred | Nominal |
|---|---|---|---|
| Cr | 15 to 17 | 15.7 to 16.3 | 16.3 |
| Co | 7 to 10 | 8.0 to 9.0 | 8.6 |
| Mo | 1 to 2.5 | 1.5 to 2.0 | 1.7 |
| W | 2 to 3.2 | 2.4 to 2.8 | 2.5 |
| Cb | 0.6 to 2.5 | 1.4 to 2.1 | 1.85 |
| Ta | <1.5 | <1.0 | 0.05 |
| Al | 3 to 3.9 | 3.2 to 3.7 | 3.5 |
| Ti | 3 to 3.9 | 3.2 to 3.7 | 3.4 |
| Zr | 0.005 to 0.060 | 0.015 to 0.050 | 0.02 |
| B | 0.005 to 0.030 | 0.005 to 0.020 | 0.016 |
| C | 0.07 to 0.15 | 0.09 to 0.13 | 0.10 |
| Ni | balance | balance | balance |

The Cb+Ta content in the alloy preferably maintains a volume fraction of the gamma-prime phase, in which columbium and tantalum participate (as well as other gamma prime-forming elements, such as aluminum and titanium), at levels similar to IN-738. To reduce material costs, columbium can be present in the alloy in an amount by weight greater than tantalum, and more preferably tantalum can be essentially eliminated from the alloy (i.e., at impurity levels of about 0.05% or less) in view of the investigation reported above. It is believed that the alloy identified above in Table II can be satisfactorily heat treated using the treatment described above, though conventional heat treatments adapted for nickel-base alloys could also be used.

While the invention has been described in terms of a preferred embodiment, it is apparent that other forms could be adopted by one skilled in the art. Therefore, the scope of the invention is to be limited only by the following claims.

What is claimed is:

1. A castable weldable nickel-base alloy in the form of a cast gas turbine engine component selected from the group consisting of shrouds, nozzles, and buckets, the alloy consisting of, by weight, about 15.0 to about 17.0% chromium, about 7.0 to about 10.0% cobalt, about 1.0 to about 2.5% molybdenum, about 2.0 to about 3.2% tungsten, about 0.6 to about 2.5% columbium, less than 1.0% tantalum, about 3.0 to about 3.9% aluminum, about 3.0 to about 3.9% titanium, about 0.005 to about 0.060% zirconium, about 0.005 to about 0.030% boron, about 0.07 to about 0.15% carbon, the balance nickel and impurities.

2. The alloy according to claim 1, wherein the columbium content in the alloy is, by weight, greater than the tantalum content in the alloy.

3. The alloy according to claim 1, wherein the columbium content is at least 1.4 weight percent.

4. The alloy according to claim 1, wherein the columbium content is about 1.4 to about 2.1 weight percent.

5. The alloy according to claim 1, wherein the columbium content is about 1.85 weight percent.

6. The alloy according to claim 1, wherein the tantalum content is up to 0.05% weight percent.

7. The alloy according to claim 1, wherein the tantalum content is about 0.05 weight percent.

8. A castable weldable nickel-base alloy in the form of a cast gas turbine engine component selected from the group consisting of shrouds, nozzles, and buckets, the alloy consisting of, by weight, about 15.7 to about 16.3% chromium, about 8.0 to about 9.0% cobalt, about 1.5 to about 2.0% molybdenum, about 2.4 to about 2.8% tungsten, about 1.4 to about 2.1% columbium, less than 1.0% tantalum, about 3.2 to about 3.7% aluminum, about 3.2 to about 3.7% titanium, about 0.015 to about 0.050% zirconium, about 0.005 to about 0.020% boron, about 0.09 to about 0.13% carbon, the balance nickel and impurities.

9. The alloy according to claim 8, wherein the tantalum content is up to 0.05% weight.

10. The alloy according to claim 8, wherein the tantalum content is about 0.05 weight percent.

11. A castable weldable nickel-base alloy in the form of a cast gas turbine engine component selected from the group consisting of shrouds, nozzles, and buckets, the alloy consisting of, by weight, about 16.3% chromium, about 8.6% cobalt, about 1.7% molybdenum, about 2.5% tungsten, about 1.85% columbium, about 0.05% tantalum, about 3.5% aluminum, about 3.4% titanium, about 0.02% zirconium, about 0.016% boron, about 0.10% carbon, the balance nickel and impurities.

* * * * *

UNITED STATES PATENT AND TRADEMARK OFFICE

CERTIFICATE OF CORRECTION

PATENT NO. : 6,902,633 B2 
DATED : June 7, 2005
INVENTOR(S) : Warren Tan King, John Herbert Wood and Ganjiang Feng It is certified that error appears in the above-identified patent and that said Letters Patent is hereby corrected as shown below:

Title page,
Item [75], Inventors, should be -- Ganjiang Feng -- instead of "Gangjigang Feng".

Signed and Sealed this

Twenty-ninth Day of November, 2005

JON W. DUDAS
*Director of the United States Patent and Trademark Office*